United States Patent [19]

Hosono et al.

[11] Patent Number: 4,709,298

[45] Date of Patent: Nov. 24, 1987

[54] METHOD AND DEVICE FOR CHARGING OR DISCHARGING A MEMBER

[75] Inventors: Nagao Hosono, Hachiohji; Yukio Nagase; Tatsuo Takeuchi, both of Tokyo; Hidemi Egami, Zama; Hiroshi Satomura, Hatogaya, all of Japan

[73] Assignee: Canon Kabushiki Kaisha, Tokyo, Japan

[21] Appl. No.: 882,206

[22] Filed: Jul. 3, 1986

Related U.S. Application Data

[63] Continuation of Ser. No. 618,249, Jun. 7, 1984, abandoned.

[30] Foreign Application Priority Data

Mar. 26, 1984 [JP] Japan ..... 59-57705
Jun. 6, 1984 [JP] Japan ..... 59-114500

[51] Int. Cl.[4] ..... H05F 3/04

[52] U.S. Cl. ..... 361/213; 361/225; 361/230; 250/326

[58] Field of Search ..... 361/212-214, 361/220, 225, 229, 230, 235; 250/324-326; 346/159; 355/3 CH

[56] References Cited

U.S. PATENT DOCUMENTS

| | | | |
|---|---|---|---|
| 3,417,302 | 12/1968 | Lueder | 361/235 X |
| 3,769,506 | 10/1973 | Silverberg | 361/229 X |
| 4,057,723 | 11/1977 | Sarid et al. | 361/225 X |
| 4,155,093 | 5/1979 | Fotland et al. | 361/225 |
| 4,409,604 | 10/1983 | Fotland et al. | 361/225 |
| 4,589,053 | 5/1986 | Hosono et al. | 361/213 |

*Primary Examiner*—L. T. Hix
*Assistant Examiner*—D. Rutledge
*Attorney, Agent, or Firm*—Fitzpatrick, Cella, Harper & Scinto

[57] ABSTRACT

A method of charging or discharging a member including the steps of, opposing to a member to be acted, a discharging member having a dielectric member, an inducing electrode and a discharging electrode sandwiching the dielectric member so that the discharging electrode faces the member to be acted, applying an alternating voltage between the inducing electrode and the discharging electrode to produce a surface discharge on a surface of the dielectric member at the discharging electrode side, wherein width of an area where the surface discharge is produced is substantially equal to width of the inducing electrode, and charging or discharging the member to be acted by the thus formed surface discharge.

10 Claims, 12 Drawing Figures

METHOD AND DEVICE FOR CHARGING OR DISCHARGING A MEMBER

This application is a continuation of application Ser. No. 618,249 filed June 7, 1984, now abandoned.

BACKBROUND OF THE INVENTION

This invention relates to a method of electrically charging or discharging a member and a discharging device using the same, which are usable with electrostatic recording, electrophotography and the like.

In the field of electrophotography and the electrostatic recording, corona chargers and dischargers are known and widely used, in which a high voltage is applied to a fine wire having a diameter 0.1 mm, for example, to produce corona, discharge. However, prior art devices involve the drawback that the wire is easily broken because it is thin. Also, the wire is easily stained or dusted, which results in non-uniform corona production, and therefore, non-uniform charging or discharging of a member to be charged or discharged. In addition, a conductive shield which encloses the corona wire has to be remote therefrom by a certain distance, so that there is a limitation in reducing the size of the device.

Another type of discharger has been proposed, as disclosed in U.S. Pat. No. 4,155,093 corresponding to Japanese Laid-Open Patent Application No. 53537/1979, wherein the dielectric member is sandwiched betweeen two electrodes. By applying alternating voltage between the electrodes, positive and negative ions are produced at the junction between the dielectric member and one of the electrodes. Of these ions, the ions of a desired polarity is extracted by an external electric field. This type of discharger is advantageous in that the size can be much reduced by making the dielectric member thin (not more than 500 microns, preferably 20–200 microns).

However, it is a drawback of those dischargers that the surface to be charged or discharged is not uniformly charged or discharged.

SUMMARY OF THE INVENTION

It is a principal object of the present invention to provide a method and a device whereby a member to be charged or discharged is substantially uniformly charged or discharged.

It is another object of the present invention to provide a device which is small in size and whereby a member to be charged or discharged is substantially uniformly charged or discharged.

It is a further object of the present invention to provide a device of high charging or discharging efficiency with a power supply of relatively low voltage.

It is a further object of the present invention to provide a method and a device which are stable in operation against variations in ambient conditions, such as the temperature and humidity and whereby a member to be charged or discharged is satisfactorily uniformly charged or discharged.

These and other objects, features and advantages of the present invention will become more apparent upon a consideration of the following description of the preferred embodiments of the present invention taken in conjunction with the accompanying drawings.

The inventors have determined that the above-described drawback occurs when a surface discharge expands or extends from a discharging electrode in the direction perpendicular to the discharging electrode. The electrode is contacted to one of the surfaces of the the dielectric member. The degree of the expansion or extension is not uniform along the length of the discharging electrode. The non-uniformness may be caused by the non-uniformness of the dielectric member material and/or scores on the surface of the discharging electrode.

According to an embodiment of the present invention, the surface discharge expansion is made uniform. Therefore, a member is uniformly charged or discharged.

DESCRIPTION OF THE PREFERRED EMBODIMENT

Figure 1:
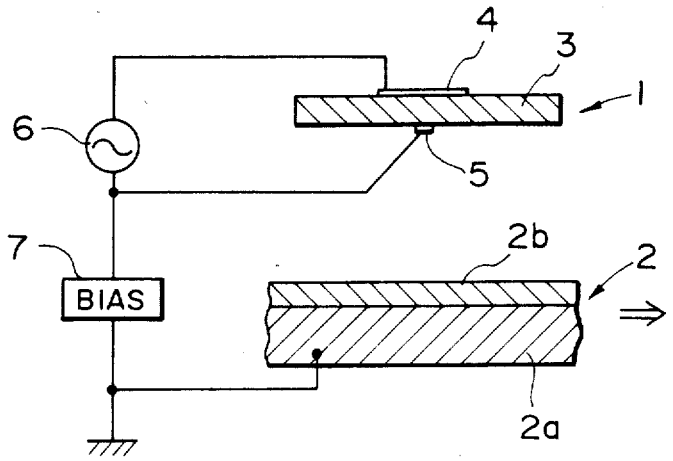
FIG. 1 shows a discharging device according to an embodiment of the present invention.
Figure 2:
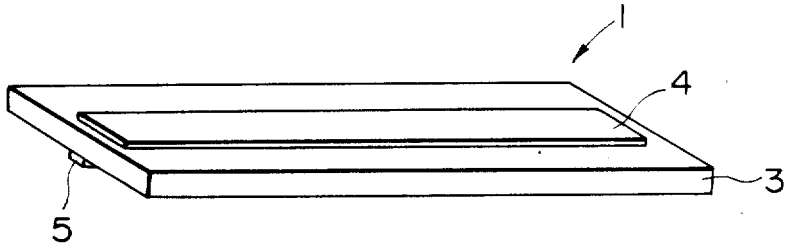
FIG. 2 perspective view of a discharging member used with the discharging device shown in FIG. 1.

Referring to FIG. 1, there is shown a discharging device according to the present invention, which includes a discharging member 1 opposed to a member 2 to be charged or discharged (hereinafter simply called a member to be charged). The discharging member 1 comprises a dielectric member 3, an inducing electrode 4 and a discharging electrode 5. FIG. 2 is a perspective view of the the discharging member 1. The discharging electrode 5 is a single linear elongate member disposed so as to extend along the center of the inducing electrode 4.

Between the inducing electrode 4 and the discharging electrode 5, an alternating voltage is applied by alternating voltage applying means 6. On the other hand, the member 2 to be charged which is moved in the direction of arrow A relative to the discharging device 1, comprises a conductive base member **2*a* and an insulating or photoconductive member 2*b*. Between the conductive layer 2*a* and the discharging electrode 5, a bias voltage is applied by bias voltage applying means 7**.

In operation, when the alternating voltage is applied between the inducing electrode 4 and the discharging electrode 5, an electric discharging occurs adjacent to the discharging electrode 5 to produce sufficient positive and negative ions. Because of the bias voltage applied between the discharging electrode 5 and the conductive base **2*a* of the member 2** the positive or negative ions are selectively extracted and directed to the insulating or photoconductive layer 2*b* surface of the member 2 so as to charge it to a desired level in the selected polarity.

As for the material of the dielectric member, a relatively high hardness material, such as ceramics, mica, glass or the like, or a flexible organic high polymer, such as polyimide resin, ethylene tetrafluoride, polyester, aclylic material vinyl chloride polyethylene or the like, may be used.

Figure 3A:
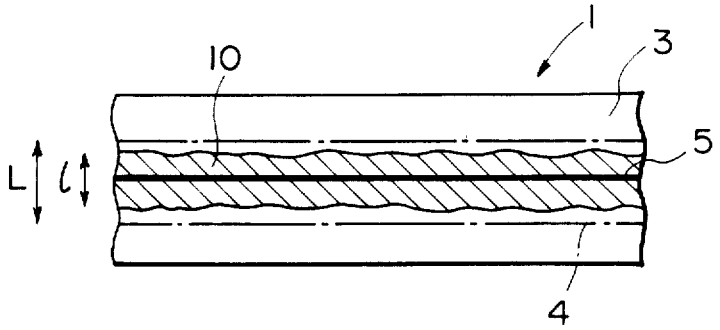
FIG. 3A shows a state of surface discharge when the present invention is not used.
Figure 3B:
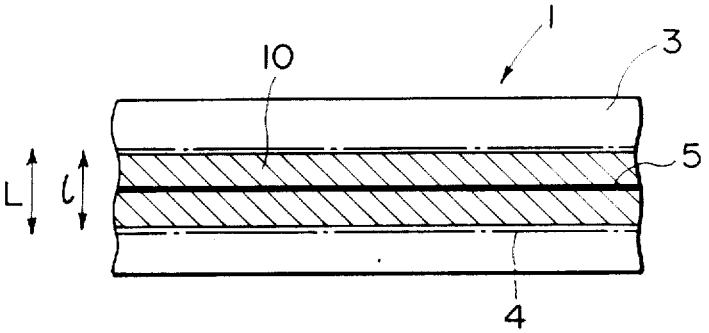
FIG. 3B shows a state of surface discharge in the charging or discharging method and in the discharging device according to an embodiment of the present invention.

FIGS. 3A and 3B show states of surface discharge at the discharging electrode 5, as seen from the side of the discharging electrode 5, when the alternating voltage is applied between the inducing electrode 4 and the discharging electrode 5 of the discharging device 1 shown in FIGS. 1 and 2. In these Figures the inducing electrode 4 contacted to the backside of the dielectric member 3 is shown by phantom lines. The width thereof is designated by L. The hatched area is the area in which the surface discharge occurs along the surface of the dielectric member 3 at the both sides of the discharging electrode 5.

FIG. 3A shows the state of the surface discharge when the present invention is not used. The surface discharge area 10 extends from both lateral sides of the discharging electrode 5, and the width l thereof is not even along the length of the discharging electrode 5. Therefore, when the member 2 to be charged is opposed to the discharging electrode 5 and moved relative thereto as shown in FIG. 1 to charge the insulating or photoconductive layer 2*a*, the surface thereof is not uniformly charged, that is, the surface potential distribution is non-uniform in the longitudinal direction, because of the above-described non-uniformness.

It has been found that the width l of the surface discharge area 10 changes with the peak-to-peak value of the alternating voltage applied between the inducing electrode 4 and the discharging electrode 5.

Figure 4:
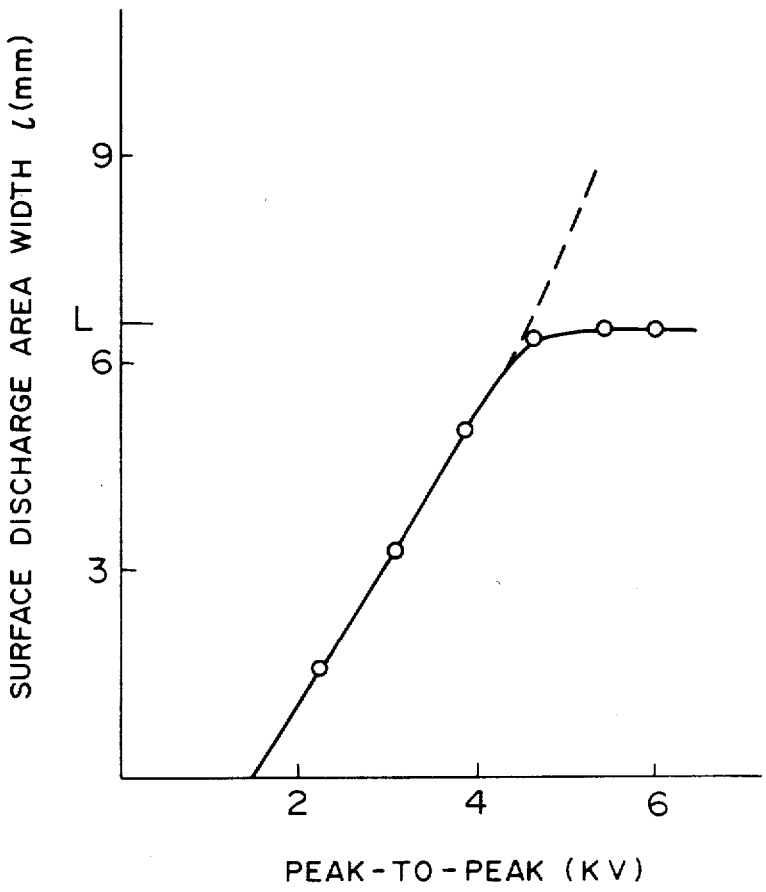
FIG. 4 shows a relation between a peak-to-peak value of an alternating voltage applied to the discharging device.

FIG. 4 shows this, the peak-to-peak value vs the width of the surface discharge area 10. The surface discharge starts at the point B. With the increase of the peak-to-peak value, the surface discharge area width increases and finally saturates. The surface discharge area width, when saturated, is substantially equal to the width L of the inducing electrode 4, that is, the surface discharge area extends substantially as far as the lateral ends of the inducing electrode 4. It does not extend beyond the lateral ends even if the peak-to-peak value is further increased. The used dielectric member 3 was of alumina ceramics having the thickness of200 microns, and the discharging electrode 3 and the inducing electrode 4 were 500 microns wide and 6.5 mm wide, respectively.

The present invention utilizes this to make uniform the surface discharge area width over the entire length of the discharging device 1, independently of the non-uniformness of the dielectric member 3 material and/or the score of the electrodes and others.

FIG. 3B shows the surface discharge of the discharging device of the present invention. The peak-to-peak value of the alternating voltage is so selected as to extend the surface discharge area substantially to the lateral ends of the inducing electrode 4 over the entire length of the discharging device 1. Then, as shown in FIG. 3B, the width of the surface discharge area 10 is substantially equal to the width of the inducing electrode 4 and therefore uniform. Since the applied voltage is alternating, the width, very strictly speaking, changes at a high frequency, but the maximum width is substantially equal to the width of the inducing electrode 4 and is uniform.

When the member 2 to be charged is subjected to the charging operation in the manner shown in FIG. 1 with the above described discharger, the member 2 to be charged is uniformly charged. As described above, the surface discharge area 10 does not extend beyond the width L of the inducing electrode 4, even if the voltage is increased. The only change is the increase of the charge density in the surface discharge area 10. The charge density within the surface discharge area 10 is uniform in the longitudinal direction.

By using this phenomenon to the maximum extent, charging can be made relatively stable to counteract a change in ambient conditions so that a satisfactory charging can be effected.

The dielectric member 3 of alumina celamics having the thickness of 200 microns was sandwiched by the discharging electrode 5 having the width of 500 microns and the inducing electrode 4 having the width of 4.5 mm. Between the discharging electrode 5 and the inducing electrode 4, an alternating voltage having the peak-to-peak value of 2 KVpp was applied. The surface discharge area did not extend to the lateral ends of the inducing electrode 4. When the member 2 to be charged was subjected to the discharging member 1 with the output of the bias voltage by the bias source 7 being 2 KV, the non-uniformness of plus and minus 8% was measured on the surface of the member 2.

Then, the alternating voltage was increased up to 4 KVpp to extend the surface discharage area 10 substantially to the lateral ends of the inducing electrode 4, and the charging was carried out under the same conditions. The measured non-uniformness was plus and minus 3%. Thus, by changing the peak-to-peak value only, more than 60% of the non-uniformness was removed.

Even if the voltage was 4 KVpp, the surface discharge area 10 did not extend to the lateral ends of the inducing electrode 4, when the width of the inducing electrode 4 is increased to 30 mm. And, plus and minus 7% non-uniformness of the charged surface was measured.

Figure 5:
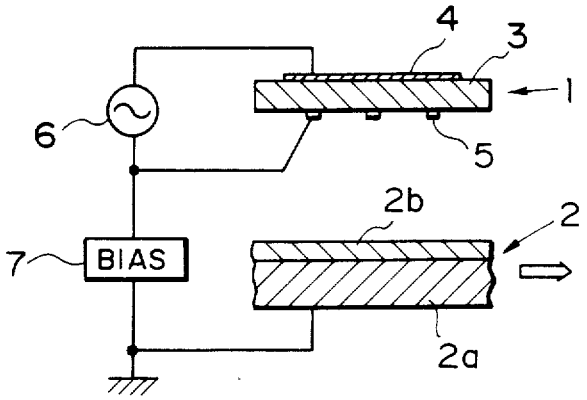
FIG. 5 shows a discharging device according to another embodiment of the present invention.
Figure 6A:
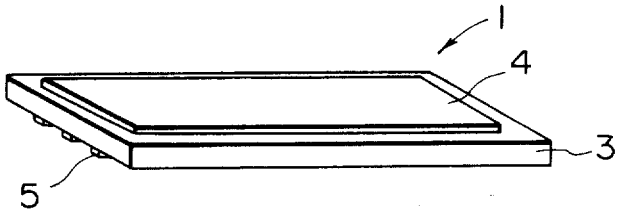
FIG. 6A is a perspective view of a discharging member used with the discharging device shown in FIG. 5.

FIGS. 5 and 6A show a discharging device according to another embodiment of the present invention. FIG. 6A is a perspective view of the discharging member 1. Since this embodiment is similar to the embodiment described with FIGS. 1 and 2, except that the discharging electrode 5 is comprised by plural rows of discharging electrode members disposed at substantially regular intervals and that the width of the inducing electrode 4 is larger correspondingly, the detailed description of the similar parts is ommited for the sake of simplicity by assigning the same reference numerals to the elements having the corresponding functions.

Figure 7A:
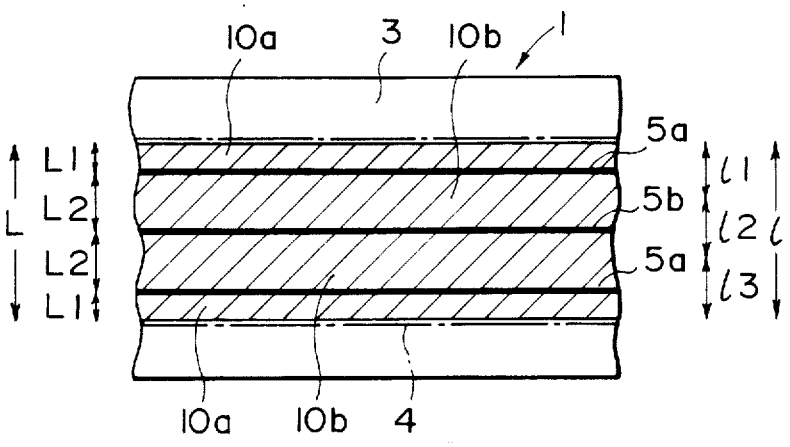
FIG. 7A shows a state of a surface discharge in the discharging device of FIGS. 5 and 6.

FIG. 7A shows the surface discharge area 10 of the discharging device shown in FIGS. 5 and 6A. The plural electrode members 5*a* and 5*b* are disposed at regular intervals. The distance L1 from the lateral end of the inducing electrode 4 to the center line of the most outside electrode member 5*a* and the interval L2 between adjacent electrode members are so related as to satisfy, the condition that L1 is equal to or larger than $(\frac{1}{2})\times L2$. The single inside electrode members (that is three electrode members in total) is shown in the Figure, but the number of the internal electrode members 5*b* is not limited and may be any number including zero. The peak-to-peak value votage is determined so that the surface discharge area 10*a* extending outwardly from the outside electrode member 5*a* reaches substantially to the corresponding lateral end of the inducing electrode 4, for each of the outside electrode members 5*a*. Then, due to the above-described dimensional conditions, the surface discharge areas extending toward each other between adjacent electrode members contact or superpose with each other.

Therefore, the surface discharge areas 10*b* inbetween are also uniform along the length of the discharger 1. The entire widths of surface discharge areas 10*a* and 10*b* at any longitudinal position is substantially equal to the width of the inducing electrode 4, so that it is uniform in the direction of the length of the discharger.

When the above conditions are not satisfied, that is, when the distance L1 from the lateral end of the inducing electrode 4 to the center line of the most outside electrode member 5*a* and the interval L2 between adjacent electrode members are such that L1 smaller than $(\frac{1}{2})\times L2$, a uniform surface discharge area 10 having the width substantially equal to the width of the inducing electrode 4 can be formed by applying such a voltage as to form a full, and therefore uniform, surface discharge area 10*b*. Under the same conditions, that is, L1 is smaller than $(\frac{1}{2})\times L2$, if the outside surface discharge area 10*a* is extended to barely reach to the lateral end of the inducing electrode 4, the inside surface discharge areas 10*b* are not superposed or contacted with the adjacent ones, but fairly uniform charging can be achieved.

When the member 2 to be charged is subjected to the charging operation in the manner shown in FIG. 5 with the above described discharger, the member 2 to be charged is uniformly charged. As described above, the surface discharge area 10 does not extend beyond the width L of the inducing electrode 4, even if the voltage is increased. The only change is the increase of the charge density in the surface discharge area 10. The charge density within the surface discharge area 10 is uniform in the longitudinal direction.

By using this phenomenon to the maximum extent, charging can be made relatively stable to counteract a change in ambient conditions so that a satisfactory charging can be effected, as in the foregoing embodiment.

Figure 6B:
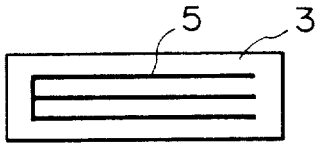
FIGS. 6B, 6C and 6D show examples of electrically connectng plural rows of discharging electrodes.
Figure 6C:
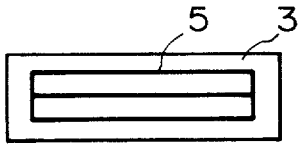
Figure 6D:
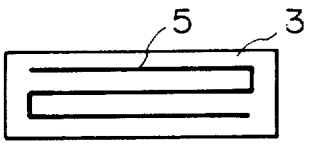

The plural rows of electrode members may be electrically connected in the fashion of a comb as shown in FIG. 6B; connected at opposite ends as shown in FIG. 6C or connected in a zig-zag fashion as shown in FIG. 6D.

When the discharging electrode is comprised by a single electrode member, the surface discharge area width is determined by the peak-to-peak value of the alternating voltage. Therefore, in order to increase the width of the surface discharge area, it is necessary to raise the voltage to relatively great extent. Where, however, a plurality of electrode members are used, the width can be increased without the necessity of raising the voltage to such an extent. The width can be increased as desired by increasing the number of the electrode members, thus remarkably enhancing the charging or discharging efficiency.

Figure 7B:
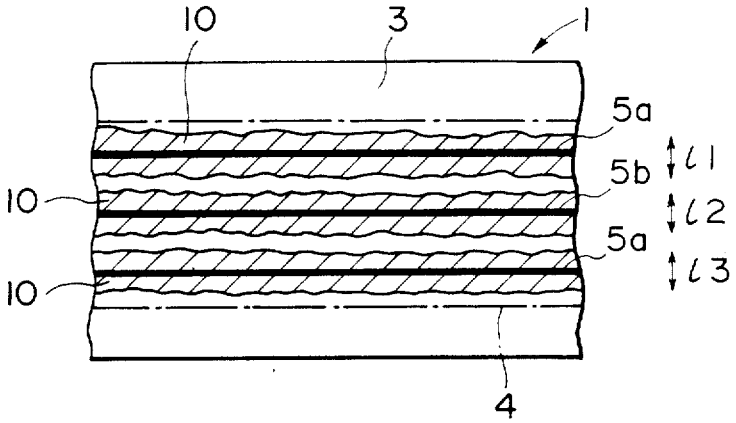
FIG. 7B shows a state of a surface discharge when the surface discharge is not sufficient.

FIG. 7B shows the surface discharge area which is different from the above. The respective surface discharge areas extending from the electrode members 5*a*, 5*b* and 5*c* have the widths 11, 12 and 13 which are not uniform in the longitudinal direction. When the member 2 to be charged is charged in the manner shown in FIG. 5 with such a discharger, the charge on the surface of the insulating or photoconductive layer is not uniform in the longitudinal direction, which, of course, is not desirable.

The dielectric member 3 of alumina celamics having the thickness of 200 microns was sandwiched by the inducing electrode 4 having the width of 14 mm and three discharging electrode members 5*a*, 5*b* and 5*c* spaced by 5 mm (L2) and each having the width of 500 microns. Between the discharging electrode members 5*a*, 5*b* and 5*c* and the inducing electrode 4, an alternating voltage having the peak-to-peak value of 2 KVpp was applied. The surface discharge area did not extend to the lateral ends of the inducing electrode 4 as in FIG. 7B. When the member 2 to be charged was subjected to the discharging member 1 with the output of the bias voltage by the bias source 7 being 2 KV, the non-uniformness of plus and minus 7.5% was measured on the surface of the member 2.

Then, the alternating voltage was increased up to 4 KVpp to extend the surface discharage area 10 substantially to the lateral ends of the inducing electrode 4, and the charging was carried out under the same conditions. The measured non-uniformness was plus and minus 2.5%. Thus, by changing the peak-to-peak value only, more than 85% of the non-uniformness was removed.

Even if the voltage was 4 KVpp, the surface discharge area 10 did not extend to the lateral ends of the inducing electrode 4, when the width of the inducing electrode 4 is increased to 60 mm. And, plus and minus 7% non-uniformness of the charged surface was measured.

In each of the above-described embodiments, surface discharge area width l is dependent on the material, dielectric constant and the surface resistivity of the dielectric member 3, but ordinary skilled in the art can determine the peak-to-peak value in accordance with those factors without difficulty.

Also, the width varies in dependence on the ambient conditions, such as atmospheric pressure, temperature, humidity and the degree of stain of the dielectric member 3 surface. The peak-to-peak value can be so determined, based on the actual conditions under which the device is used, that the surface discharge area 10 extends substantially to the lateral ends of the inducing electrode 4, and such determination is desirable.

The alternating voltage is not limited to an usual AC voltage, and may be rectangular wave voltage or pulse alternating voltage.

The foregoing explanation has been made with respect to the charging of a member. Where the discharging device is placed closer to the member, the member can be discharged, that is, an electric charge can be removed from the member. In this case, the voltage source 7 is not necessary. The present invention described is usable, and the advantages thereof can be provided, also in this case.

The voltage source 7, when used, may supply a DC voltage or pulsating voltage if the ions generated near the discharging electrode 5 can be directed to the member to be charged or discharged. The voltage of the voltage source 7 has been described as applying the voltage between the discharging electrode 5 and the member 2 to be charged or discharged, but it may be applied between the inducing electrode 4 and the member to be charged or discharged.

As described, according to the present invention, a discharging device which is small in size is provided, by which a member to be charged or discharged is uniformly charged or discharged.

While the invention has been described with reference to the structures disclosed herein, it is not confined to the details set forth and this application is intended to cover such modifications or changes as may come within the purposes of the improvements or the scope of the following claims.

What is claimed is:

1. A device for charging or discharging a member, comprising:

a discharging member including a solid dielectric member having first and second surfaces extending in a direction, an inducing electrode extending in said direction along said first surface of said solid dielectric member, said inducing electrode having a width smaller than that of said first surface of said solid dielectric member, and a discharging electrode extending in said direction along said second surface of said solid dielectric member, said discharging electrode having a width smaller than that of said second surface of said solid dielectric member, said solid dielectric member being sandwiched between each inducing electrode and said discharge electrode, said inducing electrode and said discharging electrode are in contact with said solid dielectric member, wherein said discharging electrode has an exposed side and has a width, measured in a direction perpendicular to said direction, that is smaller than that of the inducing electrode, and wherein said exposed side of said discharging electrode is adapted to be opposed to a member to be charged or discharged; and a power source for applying an alternating voltage between said inducing electrode and said discharging electrode to produce a surface discharge on said second surface of said solid dielectric member adjacent said discharging electrode wherein the width of an area where the surface discharge is produced is substantially equal to the width of said inducing electrode.

2. A device according to claim 1, wherein said discharging electrode includes plural rows of discharging electrode members located at substantially regular intervals.

3. A device according to claim 2, wherein distances between outermost discharging electrode members and respective lateral ends of the inducing electrode are not less than one half of the interval between adjacent ones of the discharging electrode members.

4. A device according to claim 2, further comprising means for applying a bias voltage having a predetermined polarity to form an electric field between said discharging electrode and the member to be charged or discharged to move ions produced by the surface discharge to the member to be charged or discharged.

5. A device according to claim 3, further comprising means for applying a bias voltage having a predetermined polarity to form an electric field between said discharging electrode and the member to be charged or discharged to move ions produced by the surface discharge to the member to be charged or discharged.

6. A device according to claim 1, further comprising means for applying a bias voltage having a predetermined polarity to form an electric field between said discharging electrode and the member to be charged or discharged to move ions produced by the surface discharge to the member to be charged or discharged.

7. A method of charging or discharging a member, comprising the steps of:

providing a discharging member which includes a solid dielectric member having first and second surfaces extending in one direction, an inducing electrode extending in the one direction along the first surface of the solid dielectric member, with said inducing electrode having a width smaller than that of said first surface of said solid dielectric member, and a discharging electrode extending in the one direction along the second surface of the solid dielectric member, with said discharging electrode having a width smaller than that of said second surface of said solid dielectric member, and thereby sandwiching the solid dielectric member between the inducing electrode and the discharging electrode, said inducing electrode and said discharging electrode in contact with said solid dielectric member wherein the discharging electrode has an exposed side and has a width, measured in a direction perpendicular to the one direction, which is smaller than that of the inducing electrdoe;

positioning a member to be charged or discharged adjacent the exposed side of the discharging electrode;

applying an alternating voltage between the inducing electrode and the discharging electrode to produce a surface discharge on the second surface of the solid dielectric member adjacent the discharging electrode wherein the width of an area where the surface discharge is produced is substantially equal to the width of the inducing electrode; and charging or discharging the member to be charged or discharged and opposed to the discharging member by the thus formed surface discharge.

8. A method according to claim 7, further comprising the steps of applying a bias voltage having a predetermined polarity to form an electric field between the discharging electrode and said member to be charged or discharged to move ions produced by the surface discharge to the member to be charged or discharged.

9. A method according to claim 7, wherein said discharging electrode includes plural rows discharging electrode members at regular intervals.

10. A method according to claim 8, wherein distances between outermost discharging electrode members and respective lateral ends of the inducing electrode are not less than one half of the interval between adjacent ones of the discharging electrode members.

* * * * *

UNITED STATES PATENT AND TRADEMARK OFFICE

CERTIFICATE OF CORRECTION

PATENT NO. : 4,709,298

DATED : November 24, 1987

INVENTOR(S) : NAGAO HOSONO, ET AL.

It is certified that error appears in the above-identified patent and that said Letters Patent is hereby corrected as shown below:

COLUMN 1

Line 7, "BACKBROUND" should read --BACKGROUND--.
Line 13, "the" (second occurrence) should be deleted.
Line 17, "corona," should read --corona--.
Line 31, "betweeen" should read --between--.
Line 35, "is" should read --are--.
Line 58, "the" should be deleted.

COLUMN 2

Line 4, "the" (first occurrence) should be deleted.
Line 33, "FIGS. 6B," should read --¶FIGS. 6B,--.
Line 34, "connectng" should read --connecting--; "electrodes. FIG." should read --electrodes. ¶FIG.--.
Line 49, "the" (second occurrence) should be deleted.

COLUMN 3

Line 9, "aclylic" should read --acrylic--.

COLUMN 4

Line 18, "celamics" should read --ceramics--.
Line 32, "discharage" should read --discharge--.
Line 53, "ommited" should read --omitted--.
Line 63, "satisfy," should read --satisfy--.
Line 68, "votage" should read --voltage--.

UNITED STATES PATENT AND TRADEMARK OFFICE

CERTIFICATE OF CORRECTION

PATENT NO. : 4,709,298

DATED : November 24, 1987

INVENTOR(S) : NAGAO HOSONO, ET AL.

It is certified that error appears in the above-identified patent and that said Letters Patent is hereby corrected as shown below:

COLUMN 5

Line 9, "inbetween" should read --in between--.
Line 19, "L1 smaller" should read --L1 is smaller--.
Line 56, "to relatively" should read --to a relatively--.

COLUMN 6

Line 5, "celamics" should read --ceramics--.
Line 21, "discharage" should read --discharge--.
Line 36, "ordinary" should read --one--.
Line 47, "an" should read --a--.

COLUMN 7

Line 24, "each" should read --said--.

COLUMN 8

Line 22, "surcface" should read --surface--.
Line 31, "electrdoe;" should read --electrode;--.
Line 53, "rows discharging" should read --rows of discharging--.
Line 55, "claim 8," should read --claim 9,--.

Signed and Sealed this

Seventh Day of June, 1988

*Attest:*

*Attesting Officer*

DONALD J. QUIGG

*Commissioner of Patents and Trademarks*